US007138891B2

(12) United States Patent
Andoh et al.

(10) Patent No.: US 7,138,891 B2
(45) Date of Patent: Nov. 21, 2006

(54) DIELECTRIC RESONATOR DEVICE, DIELECTRIC FILTER, COMPOSITE DIELECTRIC FILTER, AND COMMUNICATION APPARATUS

(75) Inventors: Masamichi Andoh, Kyoto (JP); Hiroyuki Fujino, Nagaokakyo (JP); Munenori Tsutsumi, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/242,923

(22) Filed: Oct. 5, 2005

(65) Prior Publication Data

US 2006/0028299 A1 Feb. 9, 2006

Related U.S. Application Data

(62) Division of application No. 10/797,064, filed on Mar. 11, 2004.

(30) Foreign Application Priority Data

Mar. 12, 2003 (JP) ..... 2003-067031
Jan. 30, 2004 (JP) ..... 2004-024564

(51) Int. Cl.
*H01P 7/10* (2006.01)

(52) U.S. Cl. ..... 333/202; 333/219.1

(58) Field of Classification Search ..... 333/202, 333/219, 219.1, 235
See application file for complete search history.

(56) References Cited

U.S. PATENT DOCUMENTS 4,028,652 A * 6/1977 Wakino et al. ..... 333/209
4,138,652 A * 2/1979 Nishikawa et al. ..... 333/251
4,896,125 A 1/1990 Blair et al.
5,008,640 A * 4/1991 Accatino et al. ..... 333/219.1
6,002,311 A * 12/1999 Wey et al. ..... 333/219.1
6,496,087 B1 12/2002 Hattori et al.
2003/0090342 A1* 5/2003 Wilber et al. ..... 333/202

FOREIGN PATENT DOCUMENTS

| | | | |
|---|---|---|---|
| EP | 1 098 385 A2 | | 10/2000 |
| GB | 2 276 039 A1 | | 9/1994 |
| JP | 09148810 A | * | 6/1997 |
| JP | 11-145704 | | 5/1999 |
| JP | 11-214907 | | 8/1999 |
| JP | 2000-165118 | | 6/2000 |
| WO | WO 200239535 A1 | * | 5/2002 |

* cited by examiner

*Primary Examiner*—Seungsook Ham
(74) *Attorney, Agent, or Firm*—Dickstein Shapiro LLP

(57) ABSTRACT

In a dielectric resonator device, the outer shape of a support base is larger than the bottom surface of a dielectric core which is in contact with the support base, and the support base is fixed on the inner bottom surface of the cavity with support columns at the periphery of the support base. With this configuration, an air space can be provided between the inner bottom surface of the cavity and the support base. Accordingly, the resonant frequency of the TMz mode in which the electric field vector directs perpendicularly to the surface of the support base is increased so that it is considerably away from the resonant frequency of the TE01δ multiple mode.

6 Claims, 11 Drawing Sheets

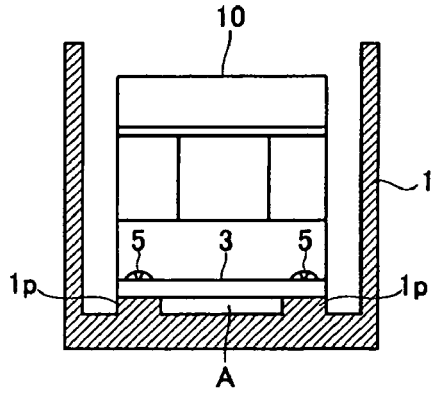
FIG. 8
FIG. 9A
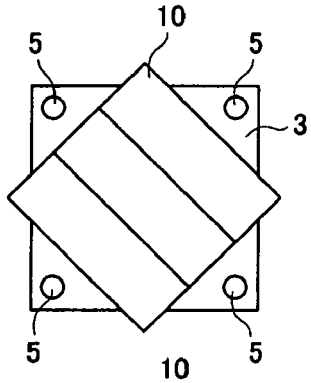
FIG. 9C
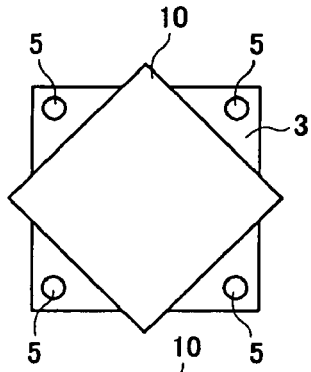
FIG. 9B
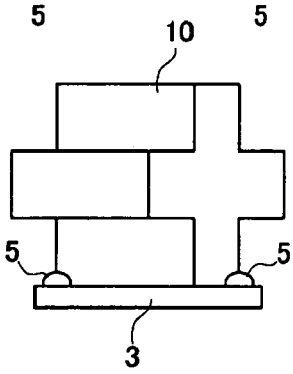
FIG. 9D
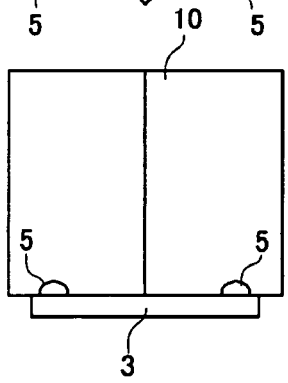
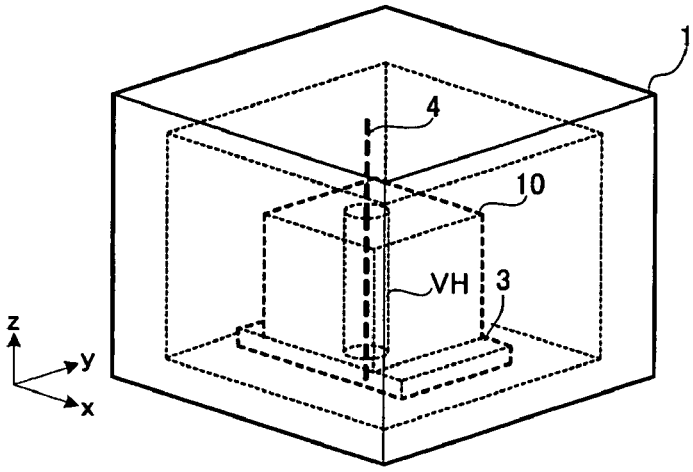
FIG. 10

DIELECTRIC RESONATOR DEVICE, DIELECTRIC FILTER, COMPOSITE DIELECTRIC FILTER, AND COMMUNICATION APPARATUS

CROSS-REFERENCE TO RELATED APPLICATION

This application is a divisional of U.S. patent application Ser. No. 10/797,064, filed Mar. 11, 2004, the entire contents of which are incorporated herein by reference.

BACKGROUND OF THE INVENTION

1. Field of the Invention

The present invention relates to a dielectric resonator device operating in a multiple mode, and also to a dielectric filter, a composite dielectric filter, and a communication apparatus provided with the above type of dielectric resonator device.

2. Description of the Related Art

Japanese Unexamined Patent Application Publication No. 11-145704 discloses a multiple-mode dielectric resonator device utilizing a plurality of resonant modes in which a dielectric core is disposed in a cavity.

In the dielectric resonator device of the above-described publication, a dielectric core generally formed in a rectangular parallelepiped is disposed at the center of a cavity generally formed in a rectangular parallelepiped. Support bases having a low dielectric constant are attached by glass glazing to the dielectric core, which is integrally formed with the cavity, provided with provisional support members, and are then fired. Subsequently, the provisional support members are removed. The structure in which a dielectric core is supported at the center of the cavity by disposing a support base under the dielectric core is also disclosed in this publication.

However, the structure in which the dielectric core is supported in the cavity by providing the provisional support members presents the following problems:

(1) complexity of the manufacturing process;

(2) necessity to increase the dimensional precision of the dielectric core, the cavity, and the support bases; and (3) complexity of molding dies for the dielectric core and the cavity.

Because of the above-described problems, the cost of the resulting dielectric resonator device becomes high.

In the structure in which the dielectric core is disposed in the cavity by disposing the support base therebetween, the effective dielectric constant in the direction in which an electric field vertically passes through the contact face between the support base and the dielectric core is increased by the height of the support base, which serves as a dielectric member, and accordingly, the resonant frequency of the resonant mode (TM mode) in the above-described direction is decreased. If the TM mode is an unwanted resonant mode, this adversely influences the characteristics, for example, filter attenuation characteristics, obtained by the other resonant modes. Even if the TM mode is utilized, the dielectric resonator device must be designed by taking into consideration the decrease in the resonant frequency due to the presence of the support base, thereby decreasing designing flexibility.

SUMMARY OF THE INVENTION

Accordingly, it is an object of the present invention to provide an inexpensive dielectric resonator device free from the problems caused by a decrease in the TM-mode resonant frequency, and also to provide a dielectric filter, a composite dielectric filter, and a communication apparatus provided with this dielectric resonator device.

In order to achieve the above object, the present invention provides a dielectric resonator device which includes a dielectric core disposed in a cavity; and a support base to which the dielectric core is attached. The support base is fixed in the cavity with an air space between the dielectric core and the inner surface of the cavity.

With this configuration, since the dielectric core is indirectly supported in the cavity with the support base therebetween, the cost of the dielectric resonator device becomes lower than that in which the dielectric core is integrally molded with the cavity. The effective dielectric constant for the electric field perpendicularly passing through the support base is reduced, and thus, the resonant frequency of the TM mode can be increased.

In the aforementioned dielectric resonator device, the outer shape of the support base may be larger than the bottom surface of the dielectric core which is in contact with the support base, and the support base may be fixed on the inner surface of the cavity with support columns at positions corresponding to the periphery of the support base which is not in contact with the bottom surface of the dielectric core. With this arrangement, the mounting of the support base on the inner surface of the cavity can be easily performed, thereby easily forming an air space between the support base and the inner surface of the cavity.

In the aforementioned dielectric resonator device, a hole may be formed in the support base at a position opposing the bottom surface of the dielectric core. With this arrangement, even when the support base is directly fixed on the inner surface of the cavity, an air space can be easily formed between the dielectric core and the cavity. When the support base having a hole is mounted on the inner surface of the cavity with the support columns therebetween, the air space between the dielectric core and the inner surface of the cavity can be even larger.

In the aforementioned dielectric resonator device, opposing parallel surfaces of the cavity may be connected to each other via a conductor wire passing through substantially the center of the dielectric core.

The present invention also provides a dielectric resonator device including a dielectric core disposed in a cavity. Opposing parallel surfaces of the cavity are connected to each other via a conductor wire passing through substantially the center of the dielectric core.

With this configuration, for the TM mode generating the electric field vector perpendicularly passing through the contact face between the support base and the dielectric core, the above-described conductor wire short-circuits the equivalent LC parallel resonant circuit, and thus, the resonant frequency of the TM mode can be considerably away from the frequency band of the TE01δ mode.

The present invention also provides a dielectric filter which includes one of the above-described dielectric resonator devices; and an external coupling unit externally coupled to the dielectric resonator device.

The present invention also provides a composite dielectric filter which includes at least two of the above-described dielectric filters. The external coupling unit of one of the dielectric filters is used as a common coupling unit for the composite dielectric filter.

In a duplexer having two dielectric filters, for example, one filter is used as a transmission filter, and the other filter is used as a reception filter, and the common external coupling unit is used as an antenna port.

With this configuration, a dielectric filter or a composite dielectric filter exhibiting a bandpass characteristic having a large attenuation in the stop band can be obtained.

The present invention further provides a communication apparatus including the above-described dielectric filter or the above-described composite dielectric filter in a high frequency circuit. Thus, an inexpensive communication apparatus can be formed.

BRIEF DESCRIPTION OF THE DRAWINGS

FIG. 8 illustrates the configuration of the main portion of a dielectric resonator device according to a third embodiment of the present invention;

FIGS. 9A through 9D illustrate the structure in which a dielectric core is fixed on the support base used in a dielectric resonator device according to a fourth embodiment of the present invention;

FIG. 10 illustrates the structure of a dielectric resonator device according to a fifth embodiment of the present invention;

DESCRIPTION OF THE PREFERRED EMBODIMENTS

The present invention is described in detail below with reference to the accompanying drawings through illustration of preferred embodiments.

A dielectric resonator device constructed in accordance with a first embodiment of the present invention is described below with reference to FIGS. 1A–1B, 2A–2B, 3A–3B and 4A–4B.

Figure 1A:
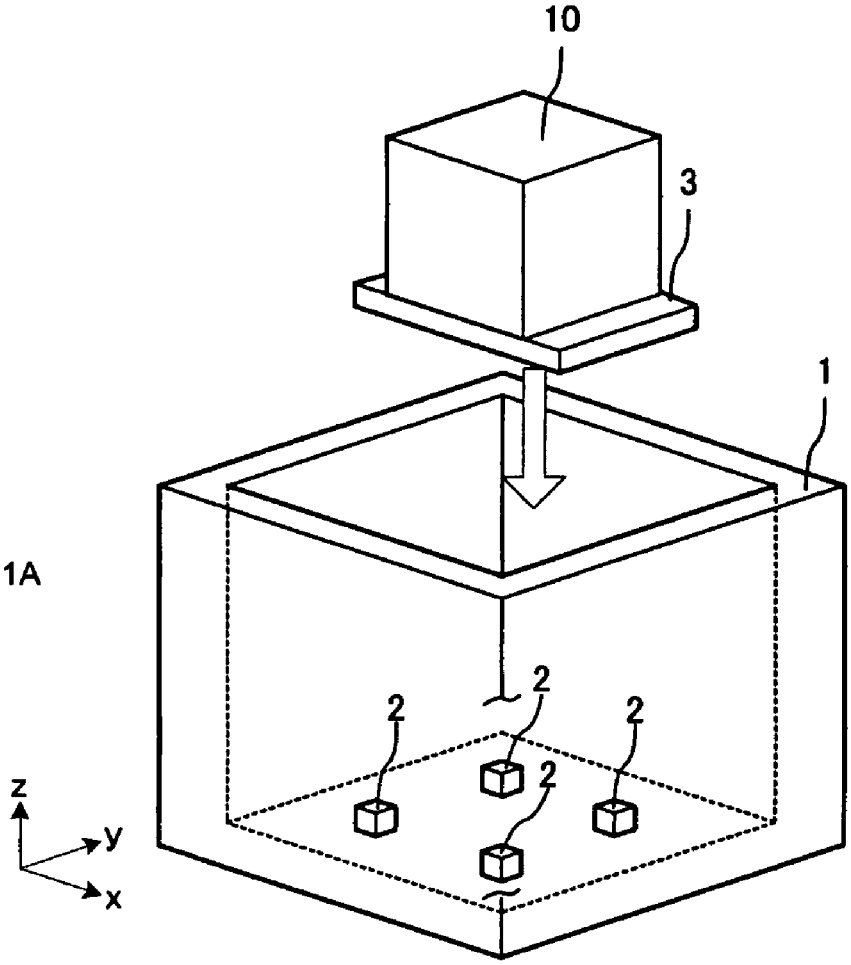
FIGS. 1A and 1B are a perspective view and a sectional view, respectively, illustrating the structure of a dielectric resonator device according to a first embodiment of the present invention.
Figure 1B:
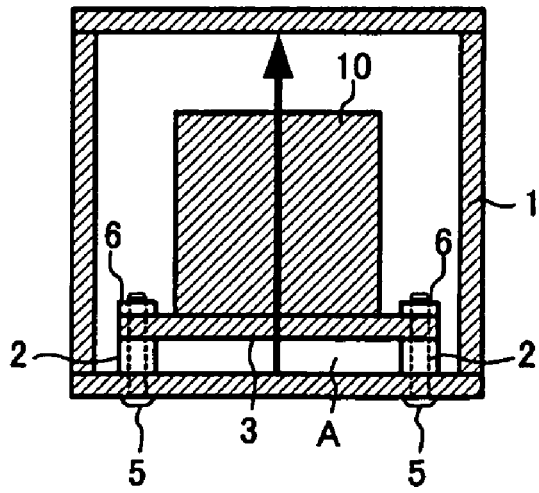

FIGS. 1A and 1B are an exploded perspective view and a sectional view, respectively, illustrating the configuration of the main portion of the dielectric resonator device. In this embodiment, a generally cubic dielectric core 10 bonded to a support base 3 is disposed within a cavity 1 so as to form the dielectric resonator device.

Figure 2A:
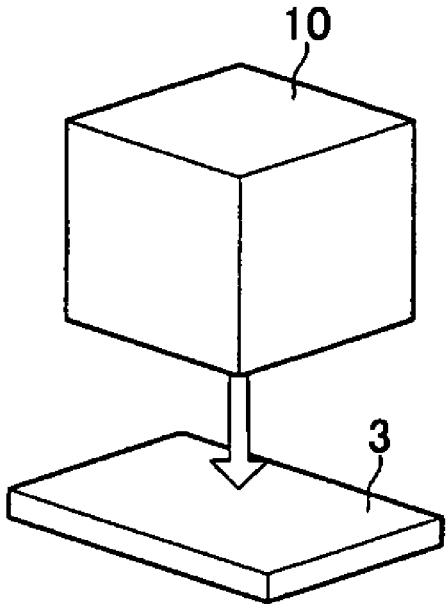
FIGS. 2A and 2B illustrate the relationship between a dielectric core and a support base used in the dielectric resonator device shown in FIGS. 1A and 1B.
Figure 2B:
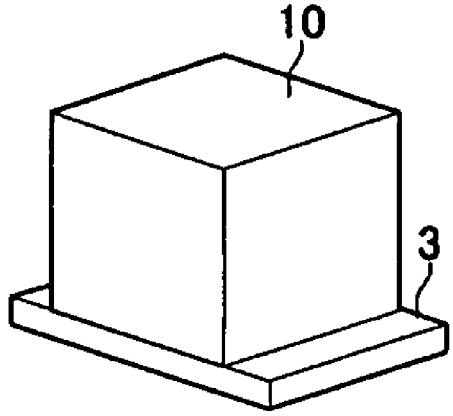

FIGS. 2A and 2B respectively illustrate the structure of the dielectric core 30 before and after being bonded to the support base 3.

As the support base 3, a ceramic sheet whose dielectric constant is low and coefficient of linear expansion is close to that of the dielectric core 10 is used. The dielectric core 10 is bonded to the support base 3 by an adhesive or glass glaze firing.

The cavity 1 is preferably a metallic molding formed with a conductive film, for example, silver electrodes, on the inner and outer surfaces. Four support columns 2 are disposed on the inner bottom surface of the cavity 1, and the support base 3 is supported in the cavity 1 by the support columns 2.

As shown in FIG. 1B, through-holes are formed at the four corners of the support base 3 and the support columns 2, and nuts 6 are fixed above the through-holes of the support base 3. When assembling, screws 5 are inserted from the bottom of the cavity 1 and are screwed into the nuts 6 so that the support base 3 is fixed relative to the inner bottom surface of the cavity 1 with the support columns 2 therebetween. With this structure, an air space A is provided between the support base 3 and the inner bottom surface of the cavity 1.

In the example shown in FIGS. 1A and 1B, the screws 5 are inserted from the bottom of the cavity 1. Alternatively, the support columns 2 may be threaded, and the screws 5 may be inserted from the inside of the cavity 1. More specifically, the support base 3 may be fixed relative to the inner bottom surface of the cavity 1 via the support columns 2 in the following manner. The support columns 2 is integrally formed in the cavity 1 by integral molding, and threads are provided in the support columns 2. Then, the screws 5 are screwed into the threads of the support columns 2 from the top of the support base 3.

When the TE resonant mode is represented in the format TEϕrz in the cylindrical coordinate system of the angle ϕ, the radius r, and the height z, three TE01δ modes orthogonal to each other are generated in the dielectric core 10 shown in FIGS. 1A through 2B. More specifically, three resonant modes, i.e., the TE01δx mode in which an electric field circulates in the plane perpendicular to the x axis, the TE01δy mode in which an electric field circulates in the plane perpendicular to the y axis, and the TE01δz mode in which an electric field circulates in the plane perpendicular to the z axis, are generated. Holes or grooves are formed in the dielectric core 10 so that, among the three TE01δ resonant modes, two resonant modes are sequentially coupled to each other. Accordingly, a dielectric filter in which three resonators are sequentially and equivalently coupled to each other is formed. When the TM resonant mode is represented in the format TMxyz in the rectangular coordinate system, the TM11δz mode (hereinafter simply referred to as the "TMz mode") in which an electric field perpendicularly (z direction) passes through the support base 3 is also generated.

The arrow shown in FIG. 1B indicates the electric field vector of the TMz mode. The electric field of the TMz mode propagates in the cavity 1 such that it passes though in the thickness direction of the air space A. Accordingly, since most of the electric field vector components pass through the air space A, the effective dielectric constant at a portion influenced by the electric field of the TMz mode is reduced, and the resonant frequency of the TMz mode is accordingly increased.

Figure 3A:
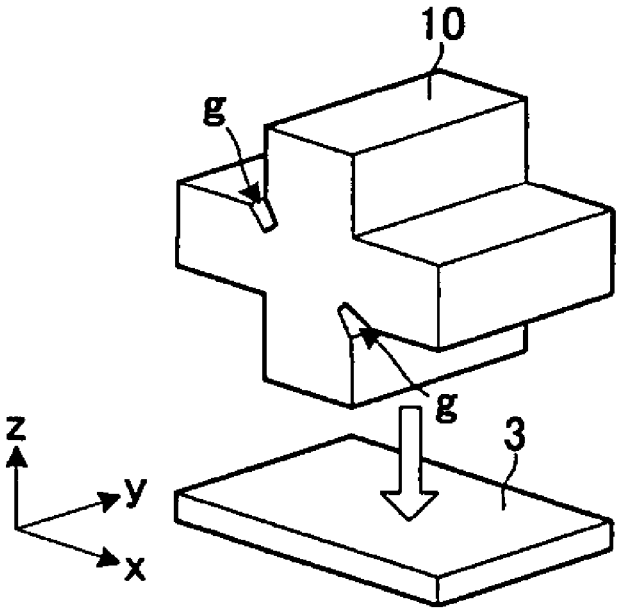
FIGS. 3A and 3B illustrate the relationship between a dielectric core having a configuration different from that shown in FIGS. 2A and 2B and the support base.
Figure 3B:
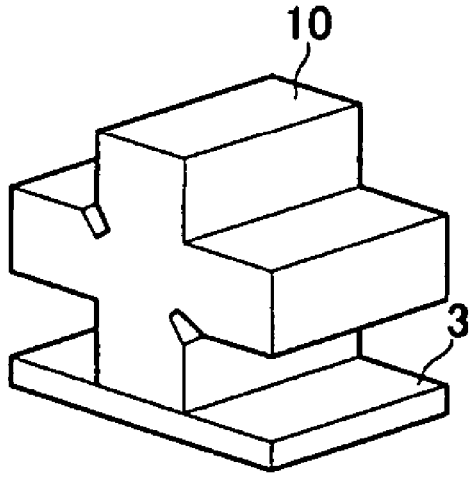

In the example shown in FIGS. 1A through 2B, the generally cubic dielectric core 10 is used. As shown in FIGS. 3A and 3B, however, the dielectric core 10 having a cross shape in section formed by integrating two rectangular parallelepipeds orthogonal to each other may be used.

In the example shown in FIGS. 3A and 3B, in the dielectric core 10, the TE01δz mode is generated in the x-y plane, and the TE01δx mode is generated in the y-z plane. By providing grooves g at the intersecting portions of the two rectangular parallelepipeds, the two resonant TE01δz and TE01δx modes are coupled to each other, and the dielectric core 10 serves as a TE01δ double mode resonator.

Figure 4A:
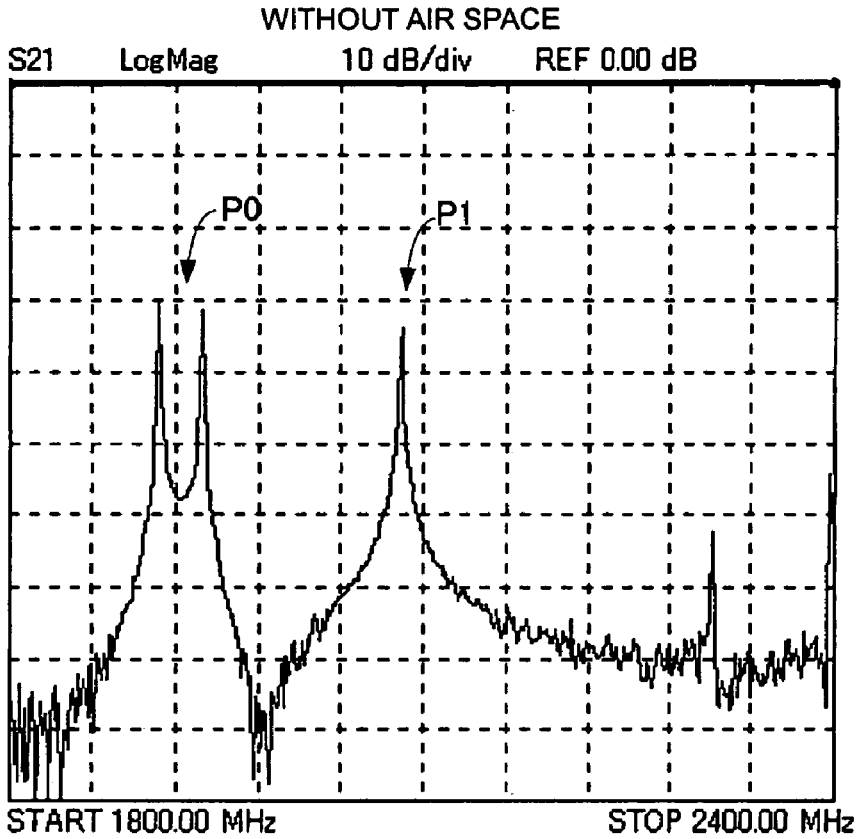
FIGS. 4A and 4B illustrate a change in the bandpass characteristic of a dielectric filter due to the presence and the absence of an air space.
Figure 4B:
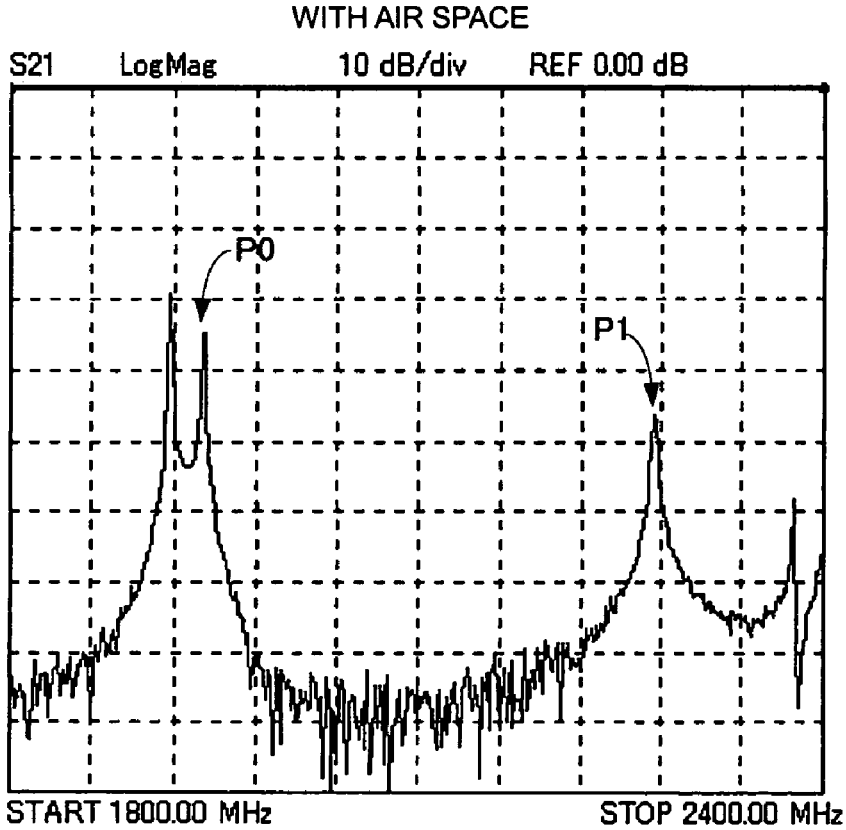

FIGS. 4A and 4B illustrate a shift in the resonant frequency of the TMz mode due to the presence and the absence of the air space A. FIGS. 4A and 4B illustrate the bandpass characteristics of a dielectric filter formed by using the dielectric core 10 having the configuration shown in FIGS. 3A and 3B. In FIGS. 4A and 4B, the vertical axis represents the attenuation in decibels in increments of 10 dB up to 0 dB. The horizontal axis designates the frequency in linear scale from 1800 to 2400 MHz.

FIG. 4A illustrates the bandpass characteristic when the support base 3 is directly fixed on the inner bottom surface of the cavity 1 without the support columns 2, i.e., without an air space. FIG. 4B illustrates the bandpass characteristic when the support base 3 is fixed on the cavity 1 with the support columns 2, i.e., with an air space of 3.0 mm therebetween. P0 indicates the resonance peak of the TE01δ double mode, and P1 represents the resonance peak of the TMz mode. FIG. 4A shows that, without an air space, the resonance peak P1 of the TMz mode appears around 2080 MHz in the vicinity of the frequency band 1900 to 1940 MHz in which the resonance peak P0 appears. By providing an air space, however, as shown in FIG. 4B, the resonance peak P1 of the TMz mode is shifted to the higher frequency range around 2280 MHz by being considerably away from the resonance peak P0. Accordingly, the adverse influence of the TMz mode on the frequency band of the TE01δ double mode can be avoided, thereby improving the attenuation characteristic of the resonance peak of the TE01δ double mode in the higher frequency range.

A dielectric resonator device and a dielectric filter constructed in accordance with a second embodiment of the present invention are described below with reference to FIGS. 5A–5B, 6A–6B and 7A–7C.

Figure 5A:
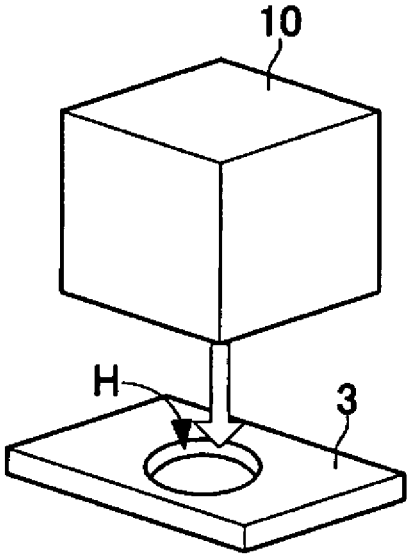
FIGS. 5A and 5B illustrate the structure of a support base used in a dielectric resonator device according to a second embodiment of the present invention.
Figure 5B:
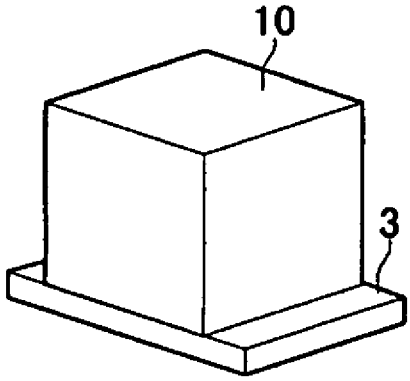

In the first embodiment, the support base 3 is fixed on the inner bottom surface of the cavity 1 with the support columns 2 therebetween so as to provide the air space A between the support base 3 and the cavity 1. In the second embodiment, a hole H, which is a through-hole or a spot facing, is formed, as shown in FIG. 5A, in the support base 3. FIG. 5B illustrates a dielectric resonator device in which the dielectric core 10 is bonded to the support base 3. The hole H is formed in a portion of the support base 3 to which the dielectric core 10 is bonded. Although only one hole H is provided in FIG. 5A, a plurality of holes H may be formed.

The support base 3 having the dielectric core 10 thereon shown in FIG. 5B may be fixed directly on the inner bottom surface of the cavity 1, or may be fixed on the cavity 1 with the support columns 2 therebetween, as shown in FIGS. 1A and 1B.

Figure 6A:
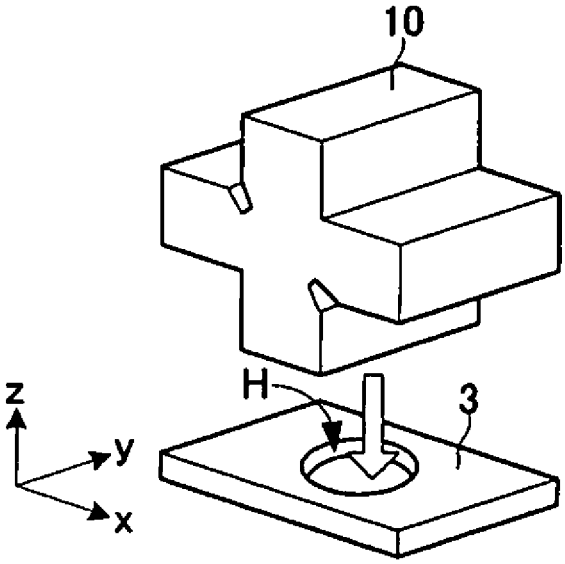
FIGS. 6A and 6B illustrate a dielectric core having a configuration different from that shown in FIGS. 5A and 5B.
Figure 6B:
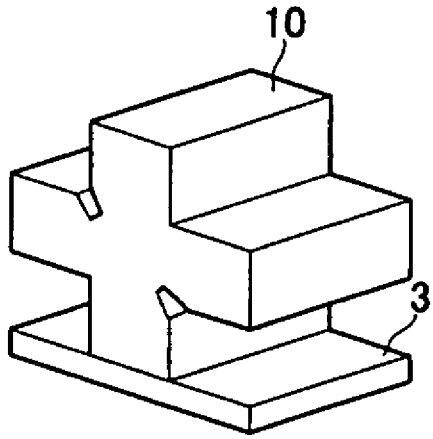

In FIGS. 6A and 6B, the dielectric core 10 similar to that shown in FIGS. 3A and 3B is used. In this case, a hole H is formed in a portion of the support base 3 to which the dielectric core 10 is bonded. The hole H may be formed large enough to partially stick out from the dielectric core 10 when the dielectric core 10 is bonded to the support base 3. Since the electric field of the TMz mode particularly concentrates on the y-z plane of the dielectric core 10, the effective dielectric constant of the portion through which the electric field vector of the TMz mode passes is considerably reduced due to the presence of the hole H, thereby increasing the resonant frequency of the TMz mode.

Figure 7A:
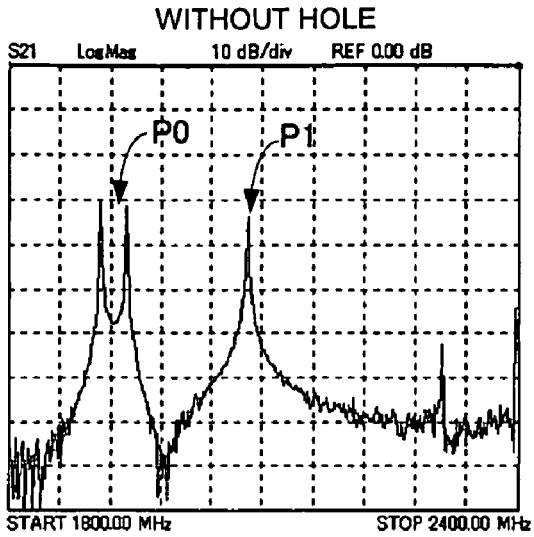
FIGS. 7A, 7B, and 7C illustrate a change in the bandpass characteristic of a dielectric filter due to the presence and the absence of an air space and due to the presence and the absence of a hole formed in the support base.
Figure 7B:
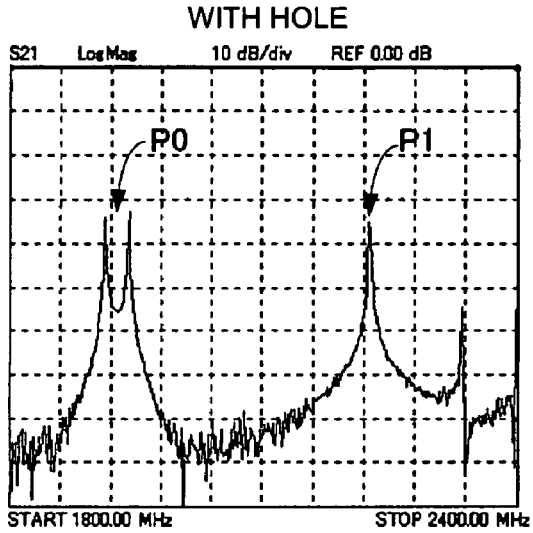
Figure 7C:
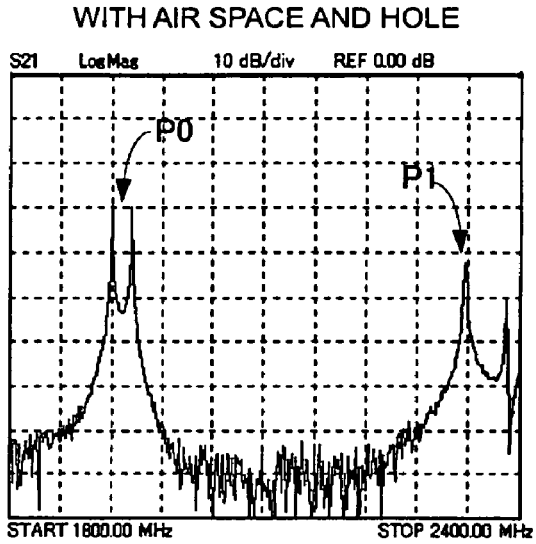

FIGS. 7A, 7B, and 7C illustrate a shift of the resonant frequency of the TMz mode due to the presence and the absence of the hole H formed in the support base 3. FIG. 7A illustrates a bandpass characteristic when the support base 3 without the hole H is directly fixed on the inner bottom surface of the cavity 1, FIG. 7B illustrates a bandpass characteristic when the support base 3 with the hole H is fixed on the inner bottom surface of the cavity 1, and FIG. 7C illustrates a bandpass characteristic when the support base 3 with the hole H is fixed on the inner bottom surface of the cavity 1 with the support columns 2 shown in FIGS. 1A and 1B. FIGS. 7A, 7B, and 7C illustrate the bandpass characteristics of a dielectric filter formed by using the dielectric core 10 having the configuration shown in FIGS. 6A and 6B. The scales of the vertical axis and the horizontal axis of FIGS. 7A, 7B, and 7C are similar to those of FIGS. 4A and 4B.

FIGS. 7A and 7B show that, by providing the hole H in the support base 3, the resonance peak P1 of the TMz mode increases from about 2080 MHz to 2230 MHz. FIG. 7C shows that, by providing an air space between the support base 3 and the cavity 1 by the support columns 2, the resonance peak P1 of the TMz mode is increased to about 2340 MHz. Accordingly, the resonance peak P1 of the TMz mode is considerably away from the frequency band of 1900 to 1940 MHz to the higher frequency range, thereby improving the attenuation characteristic of the resonance peak of the TE01 δ double mode in the higher frequency range.

FIG. 8 illustrates the configuration of the main portion of a dielectric resonator device constructed in accordance with a third embodiment of the present invention. The dielectric core 10 similar to that shown in FIGS. 3A and 3B or 6A and 6B is used. Support columns 1*p* are integrally formed with the inner bottom surface of the cavity 1 at positions corresponding to the four corners of the support base 3. Through-holes are formed at the four corners of the support base 3, and screws 5 are screwed into the support columns 1*p* of the cavity 1 from the inside of the cavity 1, thereby fixing the support base 3 to the cavity 1. Then, a cover is placed on the opened surface at the top of the cavity 1.

With this structure, the air space A can be provided between the support base 3 and the inner bottom surface of the cavity 1. Instead of allowing the support columns 1*p* to project from the inner bottom surface of the cavity 1, a recessed portion may be formed in the cavity 1 at a position corresponding to the air space A shown in FIG. 8, and such a recessed portion serves as the air space A.

FIGS. 9A through 9D illustrate the structures of a dielectric core and a support base used for a dielectric resonator device constructed in accordance with a fourth embodiment of the present invention.

FIGS. 9A and 9B are a top view and a front view, respectively, illustrating the dielectric core 10 having a cross shape in section shown in FIGS. 3A and 3B or 6A and 6B. FIGS. 9C and 9D are a top view and a front view, respectively, illustrating the dielectric core 10 having a generally cubic shape shown in FIGS. 1A and 1B, 2A and 2B, or 5A and 5B.

In this example, the outer shape of the dielectric core 10 is generally a square when viewed from the top, and the dielectric core 10 is bonded to the support base 3 such that the square-shaped dielectric core 10 is rotated at 45° with respect to the support base 3. Accordingly, the four corners of the support base 3 project from the dielectric core 10 when viewed from the top. When the support base 3 is fixed on the inner bottom surface of the cavity 1 by the screws 5, screwing can be easily performed with, for example, a driver, from the inside of the cavity 1 without being influenced by the presence of the dielectric core 10.

A dielectric resonator device and a dielectric filter constructed in accordance with a fifth embodiment of the present invention are described below with reference to FIGS. 10 through 12B.

FIG. 10 is a perspective view illustrating the dielectric resonator device. The support base 3 having the generally cubic dielectric core 10 thereon is fixed on the inner bottom surface of the cavity 1. Unlike the dielectric resonator device shown in FIGS. 1A and 1B, a vertical hole VH, which passes through in the z-axis direction, is formed at the center of the dielectric core 10 and the support base 3. A conductor wire 4 electrically connects the inner bottom surface and the top surface of the cavity 1 by passing through the vertical hole VH.

The conductor wire 4 extends along the plane in which the electric field of the TE01δx mode circulates, and also extends along the plane in which the electric field of the TE01δy mode circulates. However, since the conductor wire 4 passes through the centers of the circulating electric field vectors, it is neutral without influencing the TE01δx mode and the TE01δy mode. Also since the conductor wire 4 is perpendicular to the plane in which the electric field of the TE01δz mode circulates, it does not influence the TE01δz mode.

The support base 3 may be fixed on the inner bottom surface of the cavity 1 with the support columns 2 therebetween, as shown in FIGS. 1A and 1B.

Figure 11A:
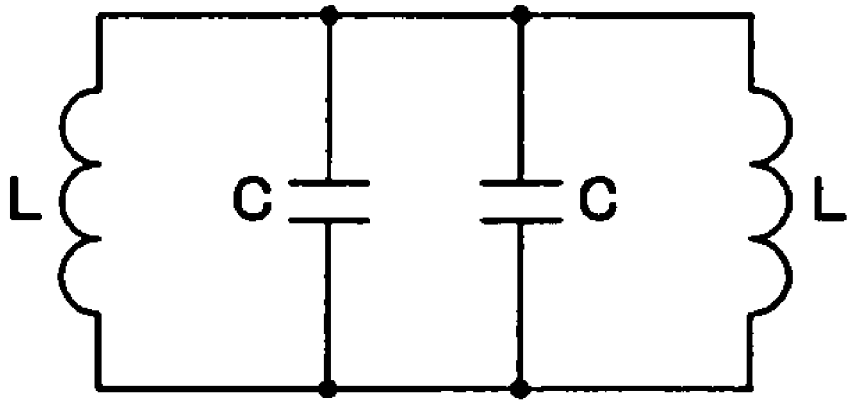
FIGS. 11A and 11B are equivalent circuit diagrams illustrating the dielectric resonator device shown in FIG. 10 in the TMz mode.
Figure 11B:
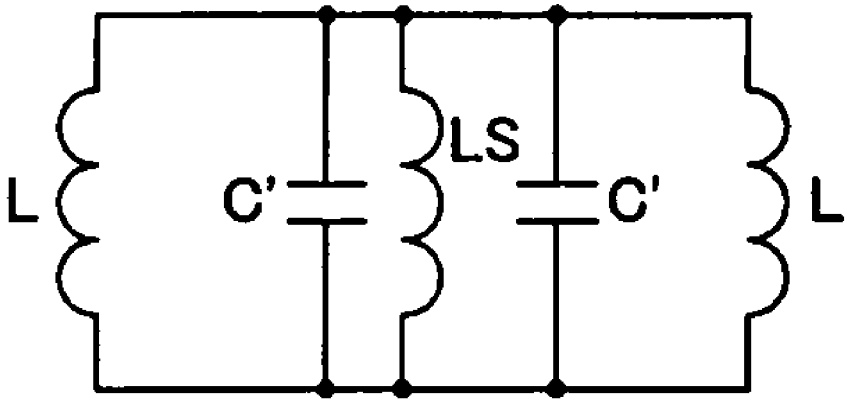

FIGS. 11A and 11B are equivalent circuit diagrams illustrating the dielectric resonator device in the TMz mode. The dielectric resonator device without the conductor wire 4 is represented by the circuit diagram in FIG. 11A. In a lumped-constant circuit shown in FIG. 11A, C designates capacitance components between the inner bottom surface and the top surface of the cavity 1 with the dielectric core 10 therebetween, and L indicates inductance components generated by the conductor of the cavity 1. Such a parallel resonant circuit determines the resonant frequency of the TMz mode. In contrast, as shown in FIG. 10, by connecting (short-circuiting) the inner bottom surface and the top surface of the cavity 1 by the conductor wire 4 by passing through the dielectric core 10, an inductance component LS generated by the conductor wire 4 is connected in parallel with capacitance components C', as shown in FIG. 11B. By providing the conductor wire 4, the capacitance components C shown in FIG. 11A is decreased to the very small capacitance components C', and thus, the resonant frequency of the TMz mode is considerably increased.

Figure 12A:
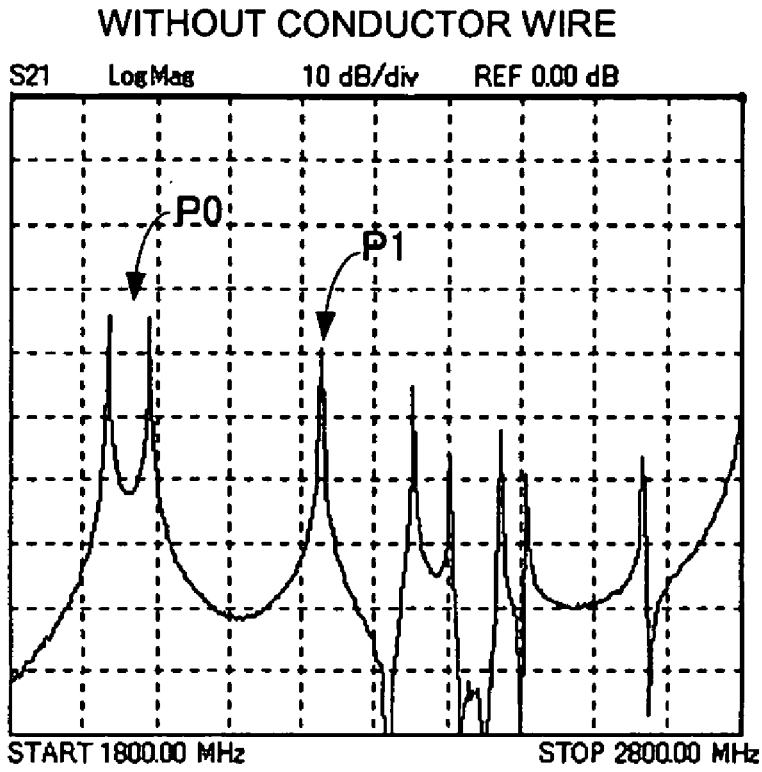
FIGS. 12A and 12B illustrate a change in the bandpass characteristic of a dielectric filter due to the presence and the absence of a conductor wire.
Figure 12B:
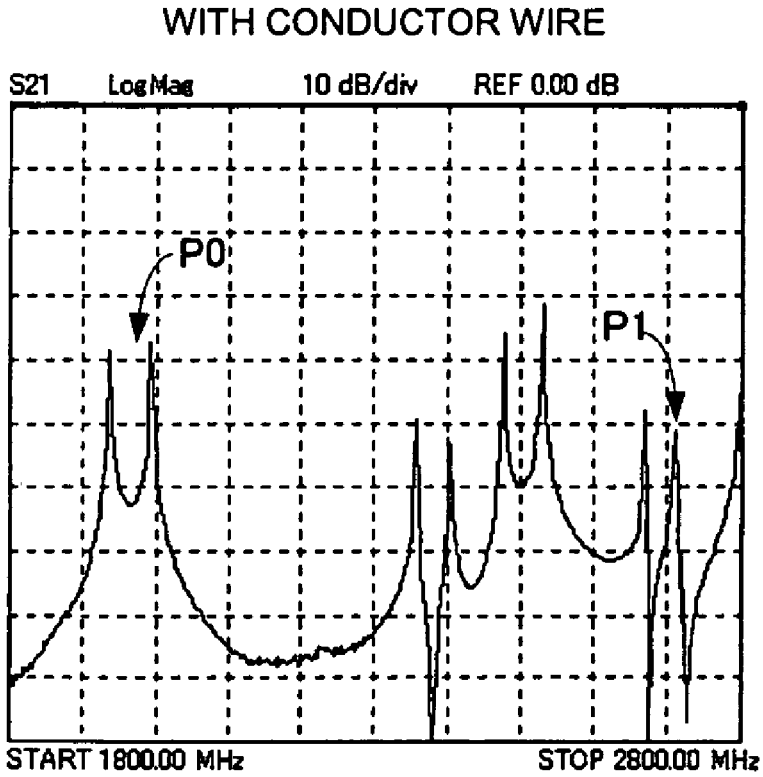

FIGS. 12A and 12B illustrate a shift in the resonant frequency of the TMz mode due to the presence and the absence of the conductor wire 4. FIG. 12A illustrates a bandpass characteristic when the dielectric resonator device is not provided with the conductor wire 4, while FIG. 12B illustrates a bandpass characteristic when the dielectric resonator device is provided with the conductor wire 4. The vertical axis represents the attenuation in decibels in increments of 10 dB up to 0 dB, as in FIGS. 4A and 4B or FIGS. 7A, 7B, and 7C. The horizontal axis designates the frequency in linear scale from 1800 to 2800 MHz.

FIG. 12A shows that, without the conductor wire 4, the resonance peak P1 of the TMz mode appears around 2220 MHz in the vicinity of the frequency band of 1920 to 2000 MHz in which the resonance peak P0 appears. In contrast, FIG. 12B shows that, with the conductor wire 4, the resonance peak P1 of the TMz mode increases to about 2710 MHz while being considerably away from the resonance peak P0 of the TE01δ double mode to the higher frequency range. As a result, the attenuation characteristic of the resonance peak of the TE01δ double mode in the higher frequency range can be considerably improved.

A dielectric resonator device constructed in accordance with a sixth embodiment of the present invention is described below with reference to FIG. 13.

Figure 13:
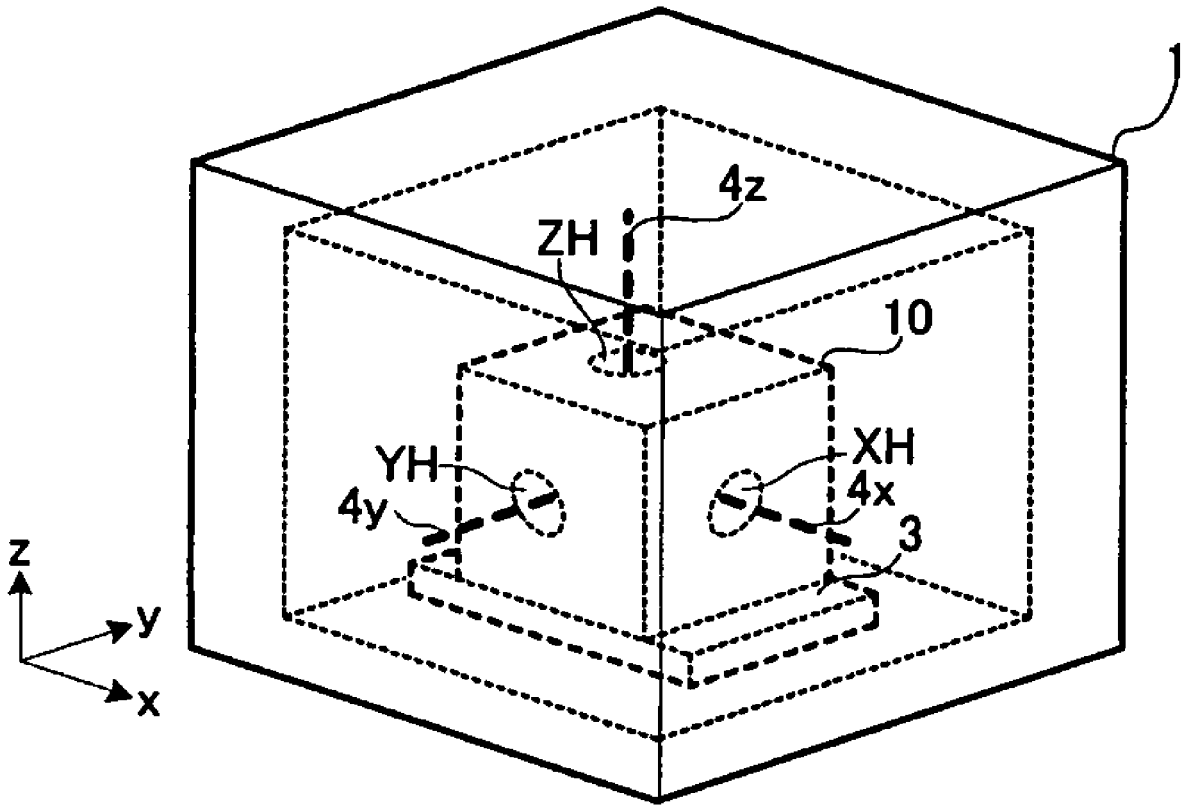
FIG. 13 illustrates the structure of a dielectric resonator device according to a sixth embodiment of the present invention.

In FIG. 13, the support base 3 having the generally cubic dielectric core 10 thereon is fixed on the inner bottom surface of the cavity 1. A hole ZH passing through in the z-axis direction is formed at the center of the dielectric core 10 and the support base 3. A conductor wire 4*z* electrically connects the inner bottom surface and the top surface of the cavity 1 by passing through the hole ZH. Unlike the dielectric resonator device shown in FIG. 10, a hole YH passing through in the y-axis direction and a hole XH passing through in the x-axis direction are also formed at the center of the dielectric core 10. A conductor wire 4*y* electrically connects the left proximal surface and the right distal surface of the cavity 1 in FIG. 13 by passing through the hole YH. A conduct wire 4*x* electrically connects the right proximal surface to the left distal surface of the cavity 1 in FIG. 13 by passing through the hole XH.

The conductor wires 4*x*, 4*y*, and 4*z* passing through the holes XH, YH, ZH, respectively, may be in a conducting state by being in contact with each other within (at the center of) the dielectric core 1, or may be in a non-conducting state by being separate from each other.

As described above, not only in the z-axis direction, but also in the y- and x-axis directions, the opposing parallel surfaces of the cavity 1 are connected with each other via the corresponding conductor wire passing through substantially the center of the dielectric core 10. Accordingly, the resonant frequencies of the TMy and TMx modes, as well as the resonant frequency of the TMz mode, are considerably increased. As a result, the attenuation characteristic of the resonance peak of the TE01δ double mode in the higher frequency range can be considerably improved without being influenced, not only by the TMz mode, but also by the TMy mode and the TMx mode.

Figures 14A, 14B:
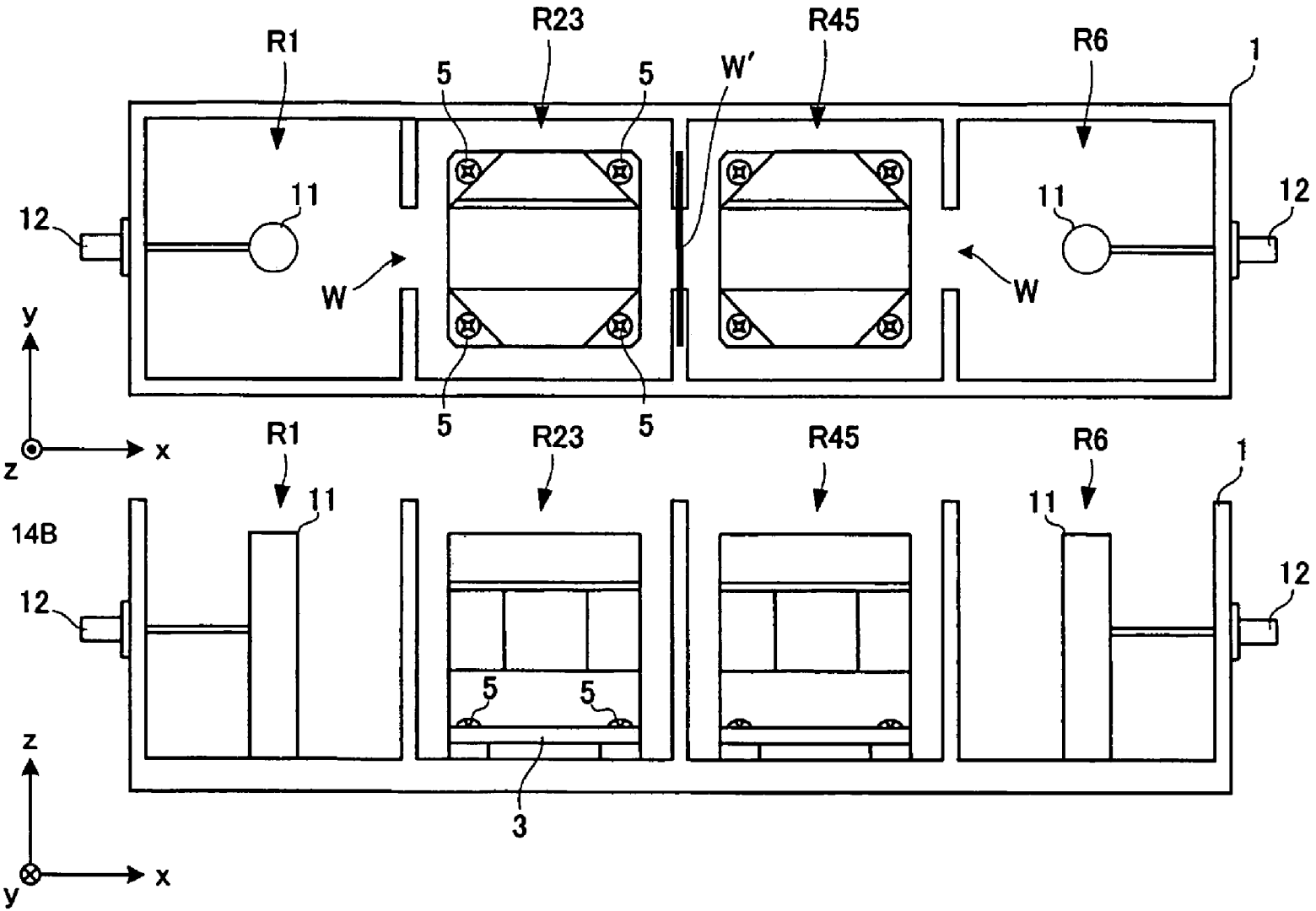
FIGS. 14A and 14B illustrate the configuration of a dielectric filter according to a seventh embodiment of the present invention.

A dielectric filter constructed in accordance with a seventh embodiment of the present invention is described below with reference to FIGS. 14A and 14B.

In the cavity 1, four resonators R1, R23, R45, and R6 are disposed. The cavity 1 is shown from which a cover at the top is removed. A dielectric core similar to that shown in FIGS. 3A and 3B is used for the resonator R23 so as to form a two-stage resonator. The dielectric core in parallel with the x-y plane is formed in an octagonal shape, as shown in FIG. 14A, by cutting the four corners. With this structure, the screws 5 can be fixed from the inside of the cavity 1 without being influenced by the presence of the dielectric core. The configuration of the resonator R45 is similar to that of the resonator R23.

The resonators R1 and R6 are semi-coaxial resonators in which central conductors 11 having a predetermined height are disposed on the inner bottom surface of the cavity 1. Coaxial connectors 12 are fixed to the outer surfaces of the cavity 1, and the central conductors of the coaxial connectors 12 are connected to the central conductors 11 of the resonators R1 and R6.

Windows W and W' are provided between the corresponding adjacent resonators. The semi-coaxial resonant mode of the resonator R1 is coupled to the TE01δy mode of the resonator R23. The TE01δz modes of the resonators R23 and R45 are coupled to each other. The TE01δy mode of the resonator R45 is coupled to the semi-coaxial resonant mode of the resonator R6. The TE01δy modes and the TE01δz modes of the resonators R23 and R45 are coupled to the corresponding modes. Accordingly, six resonators are sequentially coupled to each other between the two coaxial connectors 12. Thus, a filter having bandpass characteristics can be provided.

Figure 15:
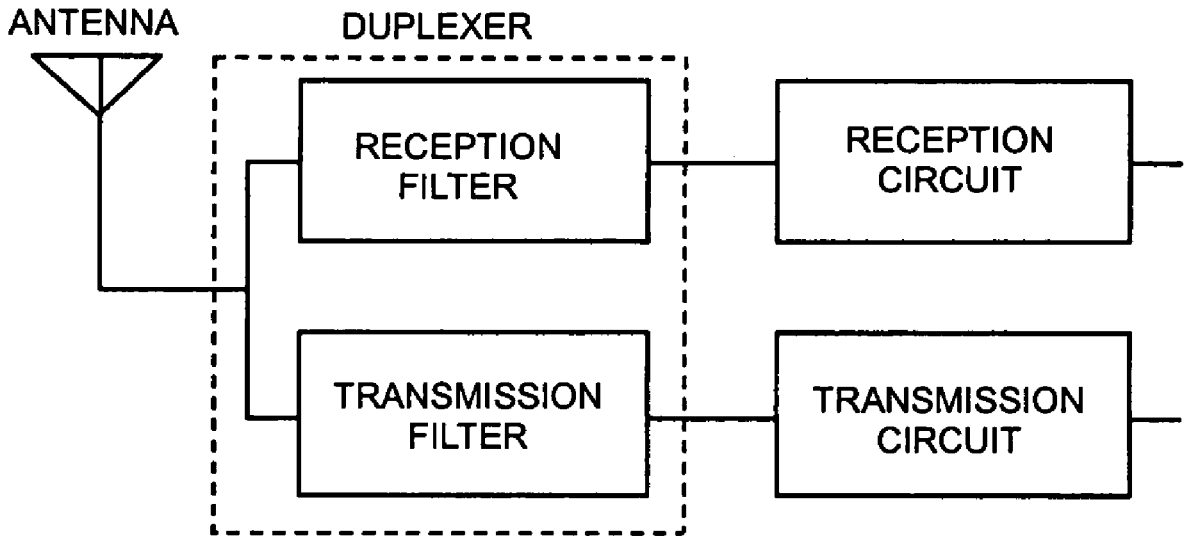
FIG. 15 illustrates the configuration of a communication apparatus according to an eighth embodiment of the present invention.

A composite dielectric filter and a communication apparatus constructed in accordance with an eighth embodiment of the present invention are described below with reference to FIG. 15.

In this composite dielectric filter or communication apparatus, a duplexer is formed of a transmission filter and a reception filter, each of which is the dielectric filter of one of the above-described embodiments. Phase adjustments are conducted between the output port of the transmission filter and the input port of the reception filter so that a transmission signal can be prevented from entering the reception filter and a reception signal can be prevented from entering the transmission filter. A transmission circuit is connected to the input port of the transmission filter, and a reception circuit is connected to the output port of the reception filter. An antenna is connected to an antenna port. With this configuration, a communication apparatus provided with the dielectric resonator device of the present invention can be formed.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric resonator device comprising:

a cavity;

a dielectric core disposed in the cavity; and a support base attached to the dielectric core, wherein the support base is fixed relative to an inner surface of the cavity such that an air space is located between the dielectric core and the inner surface of the cavity, and wherein first opposing surfaces of the cavity are connected to each other by a first conductor wire passing through substantially a center of the dielectric core in a x-axis direction, second opposing surfaces of the cavity are connected to each other by a second conductor wire passing through substantially the center of the dielectric core in a y-axis direction, and third opposing surfaces of the cavity are connected to each other by a third conductor wire passing through substantially the center of the dielectric core in a z-axis direction.

2. A dielectric resonator device comprising:

a dielectric core disposed in a cavity, wherein first opposing surfaces of the cavity are connected to each other via a first conductor wire passing through substantially a center of the dielectric core in a z-axis direction, and wherein second opposing surfaces of the cavity are connected to each other by a second conductor wire passing through substantially the center of the dielectric core in an x-axis direction, and third opposing surfaces of the cavity are connected to each other by a third conductor wire passing through substantially the center of the dielectric core in a y-axis direction.

3. A dielectric filter comprising:

the dielectric resonator device set forth in claim 2; and an external coupling unit being externally coupled to the dielectric resonator device.

4. A communication apparatus comprising:

a high frequency circuit; and the dielectric filter set forth in claim 3 provided in the high frequency circuit.

5. A composite dielectric filter comprising:

at least two of the dielectric filter set forth in claim 3;

wherein the external coupling unit of one of the dielectric filters is a common coupling unit for the composite dielectric filter.

6. A communication apparatus comprising:

a high frequency circuit; and the composite dielectric filter set forth in claim 5 provided in the high frequency circuit.

* * * * *